United States Patent [19]

Gilbert et al.

[11] 4,201,814

[45] May 6, 1980

[54] MESH STRUCTURES

[75] Inventors: John F. Gilbert, Gipsy Lane, Aston Down, Stroud, Gloucestershire; Nicholas L. Lyons, Bristol, both of England

[73] Assignees: John Francis Gilbert; Margaret Gilbert, both of Gloucestershire, England

[21] Appl. No.: 921,044

[22] Filed: Jun. 30, 1978

[30] Foreign Application Priority Data

Jul. 2, 1977 [GB] United Kingdom ..... 27799/77

[51] Int. Cl.[2] ..... B32B 5/12

[52] U.S. Cl. ..... 428/107; 428/198; 428/224; 428/910

[58] Field of Search ..... 428/105, 107, 108, 112, 428/247, 255, 910, 198, 224

[56] References Cited

U.S. PATENT DOCUMENTS

| | | | |
|---|---|---|---|
| 2,902,395 | 9/1959 | Hirschy et al. | 428/108 |
| 3,501,366 | 3/1970 | Bramley et al. | 428/107 |
| 3,554,853 | 1/1971 | Mercer et al. | 428/255 |
| 3,762,983 | 10/1973 | Osborn | 428/292 |
| 3,983,280 | 9/1976 | Bramley et al. | 428/107 |

*Primary Examiner*—James J. Bell

*Attorney, Agent, or Firm*—Scrivener, Parker, Scrivener and Clarke

[57] ABSTRACT

Mesh structure comprises an array of interconnected members of which some are pre-formed. At least some of the pre-formed members comprise or contain single elongate components of synthetic plastics material of which the molecular structure has been orientated in a direction corresponding to the longitudinal axis of said members.

10 Claims, 6 Drawing Figures

MESH STRUCTURES

SPECIFIC DESCRIPTION

This invention relates to mesh structures of the kind comprising or including pre-formed members containing synthetic plastics material and joined to one another otherwise than by knotting.

In mesh structures of the kind set forth the pre-formed members are commonly composed of or include extruded plastics material, and where this material is in the form of multiple filaments twisted together in the form of a twine or thread the resultant member is relatively flexible. The molecular structure of such filaments can be oriented in a longitudinal direction to increase the tensile strength of the member.

According to our invention in a mesh structure of the kind set forth at least some of the pre-formed members comprise or contain single elongate components of synthetic plastics material of which the molecular structure has been orientated in a direction corresponding to the longitudinal axis of the member.

Where such orientated members are joined to other members, for example by bonds comprising moulded material, it is advantageous to deform the oriented member in or adjacent to the moulded bond.

The use of such orientated members in mesh structures has a number of advantages. The members have an enhanced tensile strength, depending on the degree of orientation to which they have been subjected. The orientation can be carried out at low cost by relatively simple methods and apparatus and can result in a member of very precise cross-sectional dimension and profile. This precision is particularly advantageous where such an orientated member is bonded to another member by being entrapped in an operable mould and then surrounded by moulded materials, for example in accordance with processes described in U.K. Pat. Nos. 1,110,793 and 1,366,632. The moulds utilised in the processes described in U.K. Pat. Nos. 1,110,793 and 1,366,632 contain grooves or similar features adjacent to the mould cavity to accommodate and grip an entrapped member and if the cross-section of the said entrapped member corresponds accurately with the groove or similar feature in the moulds, spillage or flash of moulded material will be prevented. This permits more rapid moulding and also, where injection moulding of the bonding material is used, greater injection pressure can be used, giving a stronger bond. Since orientation of the material in a pre-formed member can result in an increase in the tensile and flexural modulus of the material over and above that of the unorientated material, rigidity in the mesh structure can, if necessary, be provided with relatively slender member of low weight and cost. It has been found that orientated materials in accordance with our invention exhibit superior performance when exposed to surface notching whilst subjected to longitudinal or bending tensile load. Low notch sensitively is of importance in the context of adverse mechanical, chemical, or other notching agency, such as sunlight. The said materials, where their cross-sectional dimensions are significantly greater than those of plastics filaments commonly used in twines or threads, enjoy the advantage over twines or threads that they present a greater depth of material to the penetrative degrading effects of sunlight, with resultant prolonged life in the presence of sunlight.

Some joins of members in mesh structures in accordance with our invention are shown in the accompanying drawings in which.

Mesh structure in accordance with our invention comprises a plurality of longitudinal members and a plurality of transverse members. The members are interconnected where they cross each other by means of joins. The transverse members may be normal to the longitudinal members, or they may be inclined relative thereto at any convenient angle.

Figure 1:
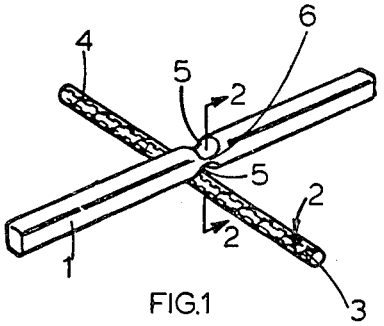
FIG. 1 is a perspective view of two members at right angles to each other before joining.
Figure 3:
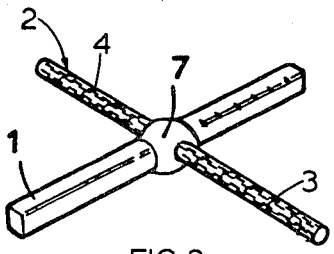
FIG. 3 shows the members of FIG. 1 joined together.

In the join illustrated in FIGS. 1 and 3 of one construction of mesh structure, the transverse members 1 comprise pre-formed members in the form of extrusions of synthetic plastics material of which the molecular structure has been orientated in a direction corresponding to the axis of the member, and each longitudinal member 2 comprises a flexible twine or thread 3 which may be composed of thermo-plastics synthetic resin and may, in addition, contain one or more filaments 4 of electrically conductive material. The orientated plastics members 1 are permanently deformed locally at spaced convenient points to define opposed recesses 5 on opposite sides of a central flattened portion 6. The twine 3 is engaged in one of the recesses, and a mass 7 of synthetic plastics material is moulded around the junction of the two members to form a join and flows into the remaining recess to strengthen the join.

Figure 4:
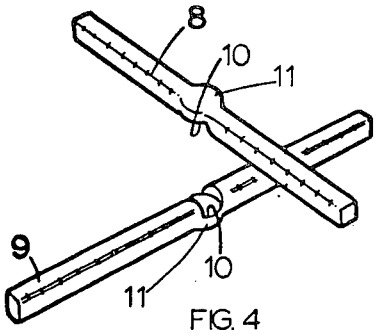
FIG. 4 is similar to FIG. 1 but with different pre-formed members.
Figure 5:
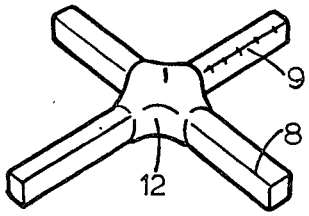
FIG. 5 shows the members of FIG. 3 joined together.

In the mesh of FIGS. 4 and 5 both longitudinal and transverse member 8 and 9 are identical in construction. Each member is formed from an extrusion identical in construction to the members 1 of the construction described above except that the permanent deformation defines a recess 10 on the inner side of a flattened portion 11 flush with the opposite side of the member. The deformations in traversing pairs of members are complementary so that they can be fitted together in registry to prevent relative movement between the members in a direction along their respective axes. Finally a mass 12 of plastics material is moulded around the junction of the two members to form a join.

Figure 2:
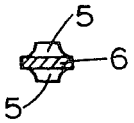
FIG. 2 is a section on the line 2—2 of FIG. 1.
Figure 6:
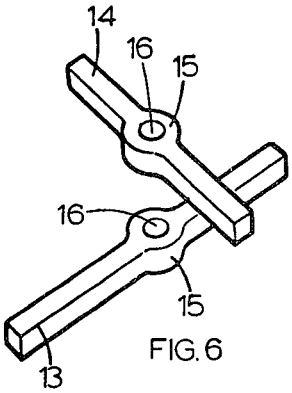
FIG. 6 is again similar to FIG. 1, but with pre-formed members of different outline.

In the construction of FIG. 6 each member 13 and 14 is formed from an extrusion identical in construction to the member 1 of the construction described above with reference to FIGS. 1 to 3, except that identical deformations 15 in the members comprises parallel sided enlarged regions provided with openings 16. When a pair of deformations 15 are superimposed with the members 13 and 14 substantially at right angles to each other, the members can be joined together by fixing or bonding material introduced into the openings 16. In addition the join may be completed at the same time by the addition of a mass of plastics material as described above.

The pre-formed extruded members 1, 8, 9, 13 and 14 may all be manufactured by the process and by the use of apparatus as described in the Specification of our co-pending Patent Application No. 27798/77 of even date. When desired some or all of the pre-formed extruded members, and usually those with which comprise the longitudinal members, may be surrounded by or otherwise contain one or more filaments of electrically conductive material of which at least portions are exposed and lie on the surface of the members.

We claim:

1. Mesh structure comprising a plurality of longitudinal members, a plurality of transverse members, and joins interconnecting said members at the junctures where said members cross each other at least some of said transverse members comprising single elongate components of synthetic plastics material of which the molecular structure has been orientated in a direction corresponding to the longitudinal axis of said member, each of said elongate components being provided at each of said joins with at lease one local pre-formed permanent deformation, and masses of plastic material moulded around the junctures of said members to form said joins.

2. A mesh structure as claimed in claim 1, wherein all said transverse members comprise single elongate components of synthetic plastics material of which the molecular structure has been orientated in a direction corresponding to the longitudinal axis of said member.

3. Mesh structure as claimed in claim 1, wherein all said members comprise single elongate components of synthetic plastics material of which the molecular structure has been orientated in a direction corresponding to the longitudinal axis of said member.

4. Mesh structure as claimed in claim 1, wherein said longitudinal members comprise flexible twines or threads.

5. Mesh structure as claimed in claim 1, wherein at least some of said longitudinal members are surrounded by or otherwise contain at least one filament of electrically conductive material.

6. Mesh structure as claimed in claim 1, wherein said deformation comprise recesses in said transverse members in which said longitudinal members are received.

7. Mesh structure as claimed in claim 6, wherein second local permanent complementary deformations are provided in opposite faces of said transverse members in positions superimposed upon said first deformations.

8. Mesh structure as claimed in claim 3, wherein said longitudinal and transverse members are both provided with local permanent deformations which are interchangeable to locate the members in a desired relative position.

9. Mesh structure as claimed in claim 8, wherein said deformations comprise recesses which are fitted together in registry to locate said members at right angles to each other.

10. Mesh structure as claimed in claim 8, wherein said deformations comprises locally flattened regions provided with apertures enabling said masses of plastics material around said deformations to flow into said apertures.

* * * * *